US009296092B2

(12) United States Patent
Jin et al.

(10) Patent No.: US 9,296,092 B2
(45) Date of Patent: Mar. 29, 2016

(54) TESTING FIXTURE FOR LIQUID CRYSTAL DISPLAY MODULE

(71) Applicant: Shenzhen China Star Optoelectronics Technology Co., Ltd., Shenzhen, Guangdong (CN)

(72) Inventors: Hao Jin, Shenzhen (CN); Guochuan Huang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 386 days.

(21) Appl. No.: 13/979,886

(22) PCT Filed: Jun. 24, 2013

(86) PCT No.: PCT/CN2013/077789

§ 371 (c)(1),
(2) Date: Jul. 16, 2013

(87) PCT Pub. No.: WO2014/169522

PCT Pub. Date: Oct. 23, 2014

(65) Prior Publication Data

US 2014/0312550 A1 Oct. 23, 2014

(30) Foreign Application Priority Data

Apr. 19, 2013 (CN) ..... 2013 1 0137911

(51) Int. Cl.
*B25B 1/22* (2006.01)
*B25B 11/00* (2006.01)

(52) U.S. Cl.
CPC ..... *B25B 11/00* (2013.01)

(58) Field of Classification Search
USPC ..... 269/71, 74, 76
See application file for complete search history.

(56) References Cited

U.S. PATENT DOCUMENTS 2,599,010 A * 6/1952 Kalman ..... B05C 13/00 269/100
3,148,461 A * 9/1964 Johnson ..... G09B 1/00 359/872
8,177,207 B2 * 5/2012 Waters ..... B05B 13/0285 118/500

*Primary Examiner* — Lee D Wilson
*Assistant Examiner* — Shantese McDonald
(74) *Attorney, Agent, or Firm* — Andrew C. Cheng

(57) ABSTRACT

The present invention provides testing fixture which comprises a main fixing device for securely holding a liquid crystal display module to be tested; an auxiliary fixing device attached to sides of the main fixing device; and an adjusting knob installed on the sides of the main fixing device and supported by the auxiliary fixing device, wherein when the auxiliary fixing device is disengaged from the main fixing device, the main fixing device can rotate centered on the knob. By the provision of the present invention of the testing fixture, when the testing direction of the liquid crystal display module needs to be changed, the changing of the direction can be readily facilitated by the testing fixture as the main fixing device can safely supported by the auxiliary fixing device. Accordingly, a single technician can safely perform the adjustment, and therefore effectively reduce the labor cost associated therewith, while the testing performance is increased. On the other hand, the main fixing device and the auxiliary fixing device can readily interlock with each other at the central position, and this is equivalent to the securing position of the liquid crystal display module is also lifted to a higher position. As a result, the overall assembly is securely positioned and free from sway wobble. Accordingly, the testing accuracy is also increased.

6 Claims, 1 Drawing Sheet

TESTING FIXTURE FOR LIQUID CRYSTAL DISPLAY MODULE

CROSS REFERENCE

This application is claiming a priority arisen from a patent application, entitled with "Testing Fixture for Liquid Crystal Liquid Module", submitted to China Patent Office on Apr. 19, 2013, designated with an Application Number 201310137911.4. The whole and complete disclosure of such patent application is hereby incorporated by reference.

FIELD OF THE INVENTION

The present invention relates to a technical field of liquid crystal display, and more particularly, to a testing fixture for a liquid crystal display module.

DESCRIPTION OF PRIOR ART

During the manufacturing of the Thin Film Transistor Liquid Crystal Display, TFT-LCD, the liquid crystal display module has to undergone a reliability test, including vibrating and impact tests, so as to ensure it durability over its service life.

During the reliability test, the liquid crystal display module is securely held within a fixture, and then the assembly is further secured to a testing table with blots so as to have the liquid crystal display module integrally attached to the testing table. While as the dimension of the liquid crystal display module becomes larger and larger, the fixture has to become larger and larger. In addition, its overall weight has also become heavier. Taking the fixture for the liquid crystal display module with 46" as example, its external dimension is 1250 mm by 800 mm, and its weight is about 46 kilograms. During the vibrating and impacting tests, the liquid crystal display module has to undergo those tests in ±X, ±Y and ±Z directions, i.e. totally six different directions. Accordingly, the testing technician has to reposition the assembly totally five (5) times in flip-and-rotate the assembly according to those six directions. According to the field requirements, for the test conducted against the liquid crystal display module over 37", it is requested to have two technicians to conduct the flip-and-rotate to ensure the safety of the technicians. Accordingly, the overall cost is inevitably increased.

In addition, when conducting the tests along the ±X and ±Y, since the fixture is merely secured by bolts on its bottom, and once the assembly become longer and longer as the size increases, the assembly tends to sway, and therefore resulting a poor testing result. After a certain period of time, the fixture tends to be damaged.

SUMMARY OF THE INVENTION

In order to resolve the above-described technical problems, a testing fixture made in accordance with the present invention is provided to ensure an excellent performance and accuracy of the testing result.

In order to resolve the problem encountered by the prior art, the present invention provides testing fixture which comprises a main fixing device for securely holding a liquid crystal display module to be tested; an auxiliary fixing device attached to sides of the main fixing device; and an adjusting knob installed on the sides of the main fixing device and supported by the auxiliary fixing device, wherein when the auxiliary fixing device is disengaged from the main fixing device, the main fixing device can rotate centered on the knob.

Wherein the main fixing device includes a rectangular frame matching to the liquid crystal display module to be tested, and includes a pair of side arms.

Wherein the auxiliary fixing device includes an vertical strut and a horizontal board perpendicular to each other, wherein the vertical strut is closely in contact with the side arm of the frame, and a bottom surface of the horizontal board is flushed with a bottom surface of the main fixing device, and the horizontal board is adapted to be mounted onto a testing table.

Wherein the knob includes a shaft extending into side arm of the main fixing device such that the main fixing device can be rotated centered on the shaft.

Wherein the knob is attached to a center of a middle portion of the side arm, and located above the auxiliary fixing device.

Wherein a notch is defined on top of the strut and the shaft of the know is disposed therein.

Wherein the side arm is defined with vertical slot corresponding to the knob for the transversal movement of the main fixing device along the shaft of the knob.

Wherein when the know is rotated into the side arm, it presses against to a top of the vertical slot.

Wherein a plurality of locking screws extend into the vertical strut and further into the side arm of the main fixing device so as to securely engage the vertical strut and the side warm, wherein the position of the locking screw is lower than the position of the knob.

Wherein a triangular reinforcing bracket is arranged between the vertical strut and the horizontal board.

The present invention further provides a testing fixture which comprises a main fixing device for securely holding a liquid crystal display module to be tested, wherein the main fixing device includes a rectangular frame matching to the liquid crystal display module to be tested, and includes a pair of side arms; an auxiliary fixing device attached to sides of the main fixing device, wherein the auxiliary fixing device includes an vertical strut and a horizontal board perpendicular to each other, wherein the vertical strut is closely in contact with the side arm of the frame, and a bottom surface of the horizontal board is flushed with a bottom surface of the main fixing device, and the horizontal board is mounted onto a testing table; and an adjusting knob installed on the sides of the main fixing device and supported by the auxiliary fixing device, wherein when the auxiliary fixing device is disengaged from the main fixing device, the main fixing device can rotate centered on the knob.

The present invention further provides a testing fixture which comprises a main fixing device for securely holding a liquid crystal display module to be tested, wherein the main fixing device includes a rectangular frame matching to the liquid crystal display module to be tested, and includes a pair of side arms; an auxiliary fixing device attached to sides of the main fixing device; and an adjusting knob installed on the sides of the main fixing device and supported by the auxiliary fixing device, wherein when the auxiliary fixing device is disengaged from the main fixing device, the main fixing device can rotate centered on the knob, wherein the knob includes a shaft extending into side arm of the main fixing device such that the main fixing device can be rotated centered on the shaft.

By the provision of the present invention of the testing fixture, when the testing direction of the liquid crystal display module needs to be changed, the changing of the direction can be readily facilitated by the testing fixture as the main fixing device can safely supported by the auxiliary fixing device. Accordingly, a single technician can safely perform the adjustment, and therefore effectively reduce the labor cost associated therewith, while the testing performance is increased. On the other hand, the main fixing device and the auxiliary fixing device can readily interlock with each other at the central position, and this is equivalent to the securing position of the liquid crystal display module is also lifted to a higher position. As a result, the overall assembly is securely positioned and free from sway wobble. Accordingly, the testing accuracy is also increased.

BRIEF DESCRIPTION OF DRAWINGS

In order to give a better and thorough understanding to the whole and other intended purposes, features and advantages of the technical solution of the present invention, detailed description will be given with respect to preferred embodiments provided and illustrated herebelow in accompanied drawings. Apparently, with the spirit of the embodiments disclosed, person in the skilled in the art can readily come out with other modifications as well as improvements without undue experiment. In addition, other drawings can be readily achieved based on the disclosed drawings.

DETAILED DESCRIPTION OF PREFERRED EMBODIMENTS

Detailed description will be given in light of the preferred embodiment along with the attached drawing figures.

Figure 1:
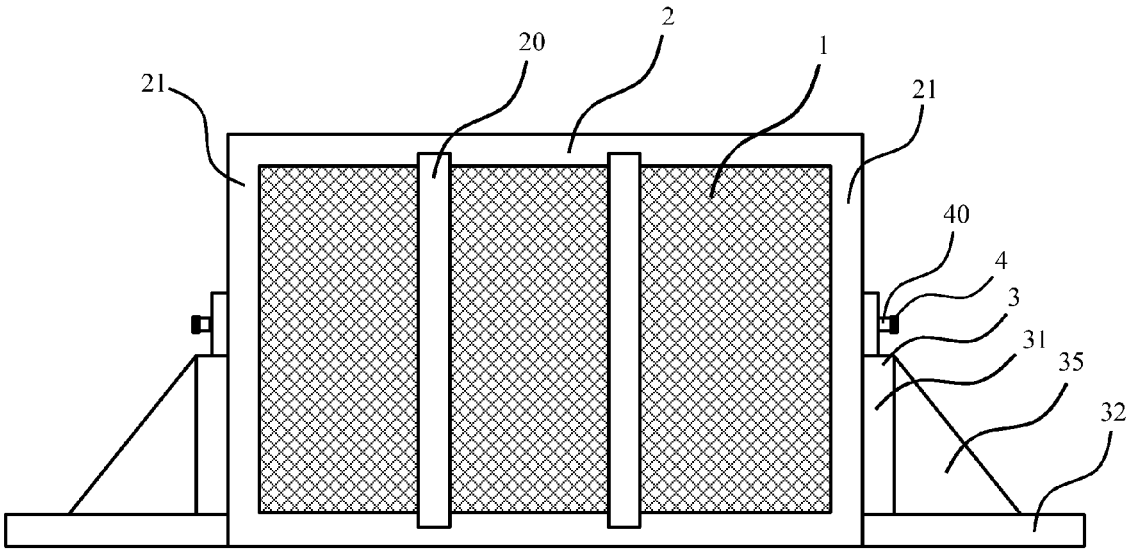
FIG. 1 is a front view of a testing fixture for liquid crystal display module made in accordance with the present invention.
Figure 2:
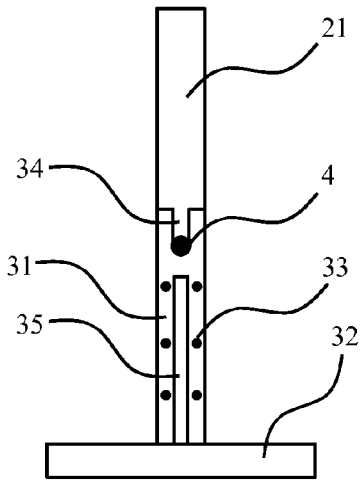
FIG. 2 is a side elevational view of the testing fixture for liquid crystal display module made in accordance with the present invention.

Referring now to FIGS. 1 and 2, during the vibrating or impacting test to the liquid crystal display module 1, currently, a main fixing device 2 is used to hold up the liquid crystal module 1. The overall configuration of the main fixing device 1 has a rectangular shape and which is similar to the liquid crystal display module 1, and have the module 1 being held therein. The main fixing device 2 further includes fixing ribs 20 for further holding up the module 1 onto the main fixing device 2, and keep the module 1 from extending out of the main fixing device 2. During the test, the main fixing device 2 can be readily secured to the testing table by means of screws or bolts. Once the test along a specific direction is completed, the screws or bolts have to be unfastened, and then flip the main fixing device 180 degrees, and then lock up the screws or bolts, and then resume the tests. When the dimension of the liquid crystal display module 1 become larger and larger, not only will have the flipping become difficult, but also will have the liquid crystal display module 1 easily be swayed as it is merely secured at the bottom. As a result, the testing result is not reliable. The present invention is to provide a testing fixture to the liquid crystal display module, and according to one of the preferred embodiments, an auxiliary fixing device 3 along the sides of the main fixing device 2. Taking one of the auxiliary fixing devices 3 as an example for illustrating, the auxiliary fixing device 3 has generally a "L-shaped" configuration and includes a vertical strut 31, and a horizontal board 32 which are perpendicular to each other. The vertical strut 31 is in closely contact with a side arm 21 of the main fixing device 2. The height of the auxiliary fixing device 3 is about half of the side arm 21. In order to have the auxiliary fixing device 3 securely engages with the main fixing device 2, the auxiliary fixing device 3 can be installed with a plurality of locking screws 33 passing through the vertical strut 31, and then screw into the side arm 21 of the main fixing device 2 such that the vertical strut 31 and the side arm 21 are securely engaged. Once the vertical strut 31 and the side arm 21 need to be disengaged with each other, the locking screws 33 can be easily loosened and then the vertical strut 31 is disengaged with the side arm 21.

According to the preferred embodiment, the testing fixture further includes a knob 4 installed on sides of the main fixing device 2, and further located above the auxiliary fixing device 3 and supported by the auxiliary fixing device 3. The knob 4 includes a shaft 40 associated therewith, and the shaft 40 extends into the side arm 21 of the main fixing device 2. When the vertical strut 31 and the side arm 21 are not in lockup, i.e. the locking screws 33 are loosened or removed, and the auxiliary fixing device 3 and the main fixing device 2 are free to move with respect to each other, the main fixing device 2 can rotate on the auxiliary fixing device 3 as centered on the shaft 40. Of course, the shafts 40 are located on both sides of the main fixing device 2, and in order to have the main fixing device 2 smoothly being rotated, the shafts 40 are coaxial to each other, i.e. there are on the same axis or central line. The knob 4 is located on the middle of the side arm 21 of the main fixing device 2, and the locking screws 33 are located in a position lower than the knob 4. The side arm 31 is defined with notch 34 from a top thereof such that the shaft 40 can be rotationally disposed therein. By this arrangement, the shaft 40 of the knob 4 can be securely and rotationally supported by the auxiliary fixing device 3.

A bottom surface of the horizontal board 32 is flushed to a bottom surface of the main fixing device 2, and with the help of the screws or bolts, the horizontal board 32 can be readily and securely mounted onto the testing table. By this arrangement, the bottom surface of the main fixing device 2 is also in close contact with the testing table. In order to enhance the intensity and rigidity of the auxiliary fixing device 3, a triangular reinforcing bracket 35.

When the vibrating or impact tests are performed to the liquid crystal display module 1, the main fixing device 1 is no longer attached to the testing table with its bottom surface instead by the implementation of the auxiliary fixing device 3 which is securely arranged on sides of the main fixing device 2, and in turn the auxiliary fixing device 3 are securely mounted onto the testing table. On the other hand, since the engagement points between the main fixing device 2 and the auxiliary fixing device 3 is generally located about the center of the main fixing device 3, i.e. about the middle point of the side arm 21, this arrangement means the fixing point is raised, and this can effectively prevent the liquid crystal display module 1 from sway during the test, and effectively increase the accuracy of the testing result.

Once a test along a certain or specific direction is completed, for example the test facing front is completed, and the module 1 needs to be tested on next direction. In this case, the locking screws 33 can be readily loosened and removed so as to disengage the interlock between the main fixing device 2 and the auxiliary fixing device 3, and further loosen the knob 4. Then, the main fixing device 2 can be readily rotated as centered on the shaft 40 of the knob 4. It should be noted that the bottom surface of the main fixing device 2 and the testing table are in close contact, accordingly, if the main fixing device 2 is still kept in such height, it is unable to rotate the main fixing device 2. In light of this, the side arm 21 of the main fixing device 2 is defined with a vertical slot with respect to the knob 4 such that the main fixing device 2 can move vertically along the vertical slot. When the shaft 40 of the knob 4 extends into the side arm 21, the shaft 40 abuts against a top of the vertical slot so as to support the main fixing device 2. With the additional stroke or displacement provided by the vertical slot, once the shaft 40 of the knob 4 is loosened, the main fixing device 2 can be lifted while the shaft 40 is supported within the vertical slot. Then the main fixing device 2 can be lifted slightly such that a clearance is provided to have the main fixing device 2 being rotated away from the testing table as centered on the shaft 40 of the knob 2. Once the main fixing device 2 is rotated to its intended position, the locking screws 33 and the knob 4 can be tightened again so as to securely position the main fixing device 2 along with the liquid crystal display module 1 for next round testing. It can be readily seen from the above description that when the liquid crystal display module 1 secured onto the main fixing device 2 is needed for changing its testing direction, it can be simply conducted by the maneuvering of the knob 4 and the auxiliary fixing device 3 on which the main fixing device 2 is supported. As a result, only one technician is needed to conduct the operation, and the labor cost is effectively reduced, while the testing accuracy is increased.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A testing fixture for liquid crystal display module, comprising:

a main fixing device for securely holding a liquid crystal display module to be tested;

an auxiliary fixing device attached to sides of the main fixing device; and an adjusting knob installed on the sides of the main fixing device and supported by the auxiliary fixing device, wherein when the auxiliary fixing device is disengaged from the main fixing device, the main fixing device can rotate centered on the knob;

wherein the main fixing device includes a rectangular frame matching to the liquid crystal display module to be tested, and includes a pair of side arms;

wherein the auxiliary fixing device includes an vertical strut and a horizontal board perpendicular to each other, wherein the vertical strut is closely in contact with the side arm of the frame, and a bottom surface of the horizontal board is flushed with a bottom surface of the main fixing device, and the horizontal board is adapted to be mounted onto a testing table;

wherein the knob includes a shaft extending into side arm of the main fixing device such that the main fixing device can be rotated centered on the shaft; and wherein the knob is attached to a center of a middle portion of the side arm, and located above the auxiliary fixing device.

2. The testing fixture as recited in claim 1, wherein a notch is defined on top of the strut and the shaft of the know is disposed therein.

3. The testing fixture as recited in claim 2, wherein the side arm is defined with vertical slot corresponding to the knob for the transversal movement of the main fixing device along the shaft of the knob.

4. The testing fixture as recited in claim 3, wherein when the knob is rotated into the side arm, it presses against to a top of the vertical slot.

5. The testing fixture as recited in claim 4, wherein a plurality of locking screws extend into the vertical strut and further into the side arm of the main fixing device so as to securely engage the vertical strut and the side warm, wherein the position of the locking screw is lower than the position of the knob.

6. The testing fixture as recited in claim 1, wherein a triangular reinforcing bracket is arranged between the vertical strut and the horizontal board.

* * * * *